US005543597A

United States Patent [19]

Watanabe et al.

[11] Patent Number: 5,543,597

[45] Date of Patent: Aug. 6, 1996

[54] GROUNDING SWITCH GEAR DEVICE

[75] Inventors: Atsuji Watanabe, Hitachi; Youichi Ohshita, Katsuta; Masatomo Ohno, Hitachi; Masanori Tsukushi, Hitachi; Shunji Tokuyama, Hitachi, all of Japan

[73] Assignee: Hitachi, Ltd., Tokyo, Japan

[21] Appl. No.: 225,979

[22] Filed: Apr. 12, 1994

[30] Foreign Application Priority Data

Apr. 20, 1993 [JP] Japan ..... 5-092618

[51] Int. Cl.[6] ..... H01H 33/88

[52] U.S. Cl. ..... 218/60; 218/59; 218/57

[58] Field of Search ..... 200/144 R, 145, 200/146 R, 146 A, 148 R, 148 A, 148 B, 150 R, 150 G; 218/43, 44, 46, 51, 52, 53, 54, 57–64, 66, 68, 71–73, 86, 88

[56] References Cited

U.S. PATENT DOCUMENTS

| | | | |
|---|---|---|---|
| 4,440,997 | 4/1984 | Garzon | 200/148 A |
| 4,598,188 | 7/1986 | Schötzau et al. | 200/148 A |
| 4,992,634 | 2/1991 | Thuries et al. | 200/148 R |
| 5,001,314 | 3/1991 | Thuries et al | 200/148 B |
| 5,155,314 | 10/1992 | Dufournet et al. | 200/148 A |

FOREIGN PATENT DOCUMENTS

| | | | |
|---|---|---|---|
| 283728A1 | 9/1988 | European Pat. Off. | H01H 33/74 |
| 475270A2 | 3/1992 | European Pat. Off. | H01H 33/91 |
| 2660792 | 10/1991 | France | H01H 33/88 |
| 63-88723 | 4/1988 | Japan | H01H 33/91 |

*Primary Examiner*—Kristine L. Kincaid
*Assistant Examiner*—Michael A. Friedhofer
*Attorney, Agent, or Firm*—Fay, Sharpe, Beall, Fagan, Minnich & McKee

[57] ABSTRACT

A first puffer chamber is formed by a puffer cylinder having a substantially cylindrical flange portion and a shaft portion, and a fixedly disposed piston. The piston is formed in a cylindrical shape sealed with respect to an external space, and is constituted to be accommodated in the flange portion of the puffer cylinder at the circuit breaking position of the circuit breaking unit. The internal space of the piston is constituted as a second puffer chamber which is designed to communicate with the first puffer chamber. The gas accumulated in the second puffer chamber is continuously blown out toward between the electrodes, thereby prolonging an effective interruptable arc time span without increasing the size of the circuit interrupting unit and operating unit.

16 Claims, 7 Drawing Sheets

GROUNDING SWITCH GEAR DEVICE

BACKGROUND OF THE INVENTION

1. Field of the Invention

The present invention relates to a puffer type gas circuit breaker which is designed to compress $SF_6$ gas in a puffer cylinder, to blow out the compressed $SF_6$ gas toward a contact portion and to extinguish an arc generating at the contact portion, and, in particular, relates to a grounding switch gear device with an improved circuit breaking unit which is suitable for prolonging an interruptable arc time span.

2. Related Art

A conventional circuit breaker is designed to open-circuit a grounded power transmission line at the time of accident, in particular when lightning causes damage, in the power transmission line, and to interrupt the current flowing therethrough. However, if the circuit opening condition is maintained, interruption of the power supply is continued so that to avoid such a condition, the power transmission line is usually reclosed in about one second. However, in the case of a large electric power transmission system, because of a high transmission line voltage and large electrostatic capacity between transmission lines, the continuing time of a secondary arc is prolonged due to electrostatic induction from a sound phase after interrupting the failed phase. Such makes a high speed reclosing operation in about one second difficult, however, which is desired in view of an effective power transmission system operation.

In order to overcome the above problem through grounding both ends of the open-circuited fault phase by high speed automatic grounding devices HSGS as illustrated in FIG. 8, the secondary arc $A_2$ is extinguished. Immediately thereafter, the high speed automatic grounding devices are open-circuited and the interrupted failed phase is reclosed. However, when a following accident is generated during the circuit opening operation of the high speed automatic grounding devices, a zero missing current condition in which the waveform of the AC current never passes through zero level as illustrated in FIG. 2 may occur, and such fault current in the zero missing current condition cannot be interrupted by the conventional circuit breaker.

It usually takes time of about four cycles until the zero missing current condition restores to a current condition having an ordinary AC waveform. The time of about four cycles corresponds to an arc extinguishing time of such following accident which is determined by the sum of a relaying time of two cycles from detection of the following accident to generation of an interruption command signal and an interrupting time of two cycles. Accordingly, when it is required to interrupt a current in the zero missing current condition with a gas circuit breaker, the gas circuit breaker is required to have a long interruptable time span of about four cycles.

However, in the conventional puffer type gas circuit breaker, all of the compressed gas in the puffer cylinder is blown out to the contact portion at the end of the circuit breaking operation, and it has been impossible to achieve such a long interruptable time span of about four cycles.

For fulfilling such necessity, a conventional countermeasure has been proposed to extend the distance between electrodes of the contact portion. JP-A-63-88723(1988) discloses an example of such a conventional countermeasure.

The structure of extending the distance between electrodes of the contact portion as referred to in connection with the conventional countermeasure increases the size and weight of the entire device which also increases the size and weight of the operating unit for the circuit breaker. As a result, the space at the installation site of the device is likely to be expanded.

SUMMARY OF THE INVENTION

An object of the present invention is to provide a grounding switch gear device which can prolong an interruptable arc time span and can interrupt a large current without increasing the size of the circuit breaking unit.

In the grounding switch gear device of the present invention, in order to blow out compressed $SF_6$ gas to the contact portion even after the completion of the circuit breaking operation, $SF_6$ gas is filled in the portion which was conventionally used for accommodating the flange of a puffer cylinder so as to constitute a second puffer chamber of which volume is designed not to change between the initiation of the circuit breaking operation and the completion thereof.

With the present invention, the portion which was conventionally used only for accommodating the flange of the puffer cylinder is used as a space for a gas chamber so as to increase the volume of the puffer chamber; thereby, a long interruptable time span of about four cycles is realized.

DETAILED DESCRIPTION OF THE EMBODIMENTS

Figure 1:
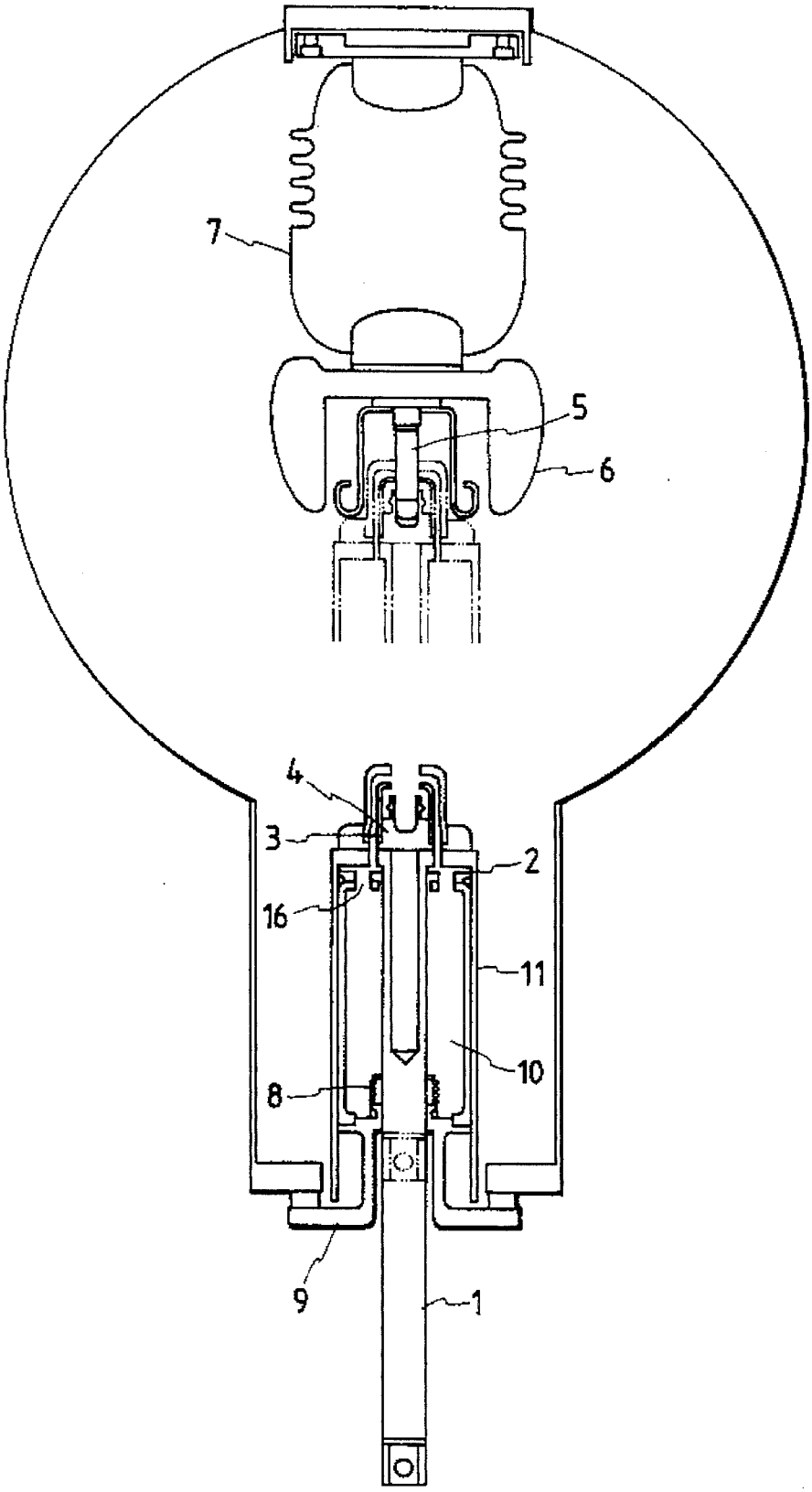
FIG. 1 is a side cross-sectional view of one embodiment of the grounding switch gear device according to the present invention.

Hereinbelow, the present invention is explained with reference to one embodiment of a grounding switch gear device as shown in FIG. 1.

In the drawing, the portion indicated by a two-dot chain line illustrates a puffer cylinder 11 serving as a movable electrode in its circuit making condition, and the portion indicated by a solid line illustrates its circuit breaking condition.

The circuit making operation is performed as follows. At first, when a fault is generated at an electric power transmission line and circuit breakers at both ends of the fault phase are operated to interrupt the fault phase, a circuit making command is issued to the grounding switch gear device from an external control unit, and the puffer cylinder 11 is pushed and driven upward in the drawing by a not-illustrated operating unit. At this instance, the puffer cylinder 11 is further moved upward in the drawing while charging $SF_6$ gas into a first puffer chamber 2 and a second puffer chamber 10 through a flow passage 3 and, when a movable contact 4 reaches the circuit making position and contacts with a stationary contact 5, the circuit making operation is completed. Then, an induction current from a sound phase begins to flow therethrough. At this moment, the current flows through a conductor 6 supported by an insulator cylinder 7, the stationary contact 5, the movable contact 4, the puffer cylinder 11, and a current collector 8 to another terminal 9 and then to the ground.

The circuit breaking operation is performed as follows. At first, when a circuit breaking command is issued from the external control unit, the puffer cylinder 11 is pulled downward in the drawing by the not-illustrated operating unit. At this instance, the $SF_6$ gas charged in the first puffer chamber 2 and the second puffer chamber 10 begins to be compressed, wherein both chambers 2 and 10 are communicated via a communication hole 16. When the circuit breaking operations further advances, the movable contact 4 separates from the stationary contact 5 and an arc is generated between the movable contact 4 and the stationary contact 5. Simultaneously, the $SF_6$ gas compressed in the first puffer chamber 2 and the second puffer chamber 10 is blown out through the flow passage 3 toward the arc generated between the movable contact 4 and the stationary contact 5 and extinguishes the arc.

When the circuit breaking operation further advances, the puffer cylinder 11 serving as the movable electrode reaches the circuit breaking position and the circuit breaking operation is completed. However, compressed $SF_6$ gas is still accumulated in the second puffer chamber 10 as if a dead volume, and the $SF_6$ gas in the second puffer chamber 10 continues to blow out until the pressure therein drops to the ordinary pressure in the tank. At the end of the $SF_6$ gas blow out, the current interruption is completed.

Figure 2:
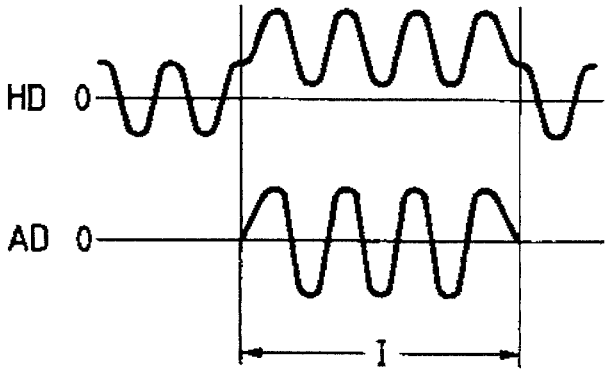
FIG. 2 is a waveform diagram illustrating a zero missing current condition.
Figure 3:
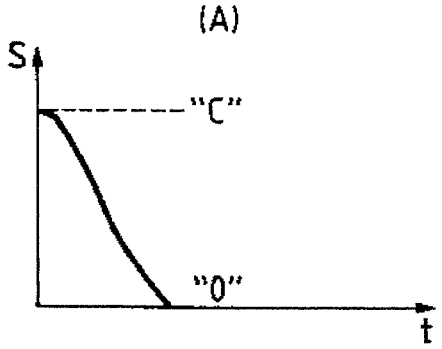
FIG. 3(A) illustrates the stroke of the puffer cylinder serving as a movable electrode.
FIG. 3(B) is a characteristic diagram illustrating pressure variations in a conventional grounding switch gear device and that of the present invention.
Figure 3:
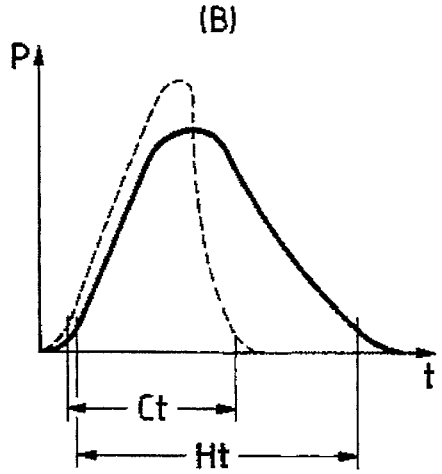

Since the time span of this series of current interrupting operation is more than four cycles and, if a following line fault is generated and the zero missing current condition as illustrated in FIG. 2 occurs, the current interruption can be successfully performed because such zero missing current condition restores to a waveform of an ordinary current after about four cycles. Pressure variations in the first puffer chamber 2 and the second puffer chamber 10 during the current interrupting operation are shown in FIG. 3 (B). Letter S in FIG. 3(A) represents displacement of the puffer cylinder 11 serving as the movable electrode from the circuit making position "C" to the circuit breaking position "0", and letter and P in FIG. 3(B) represents pressure rise at that moment. The puffer pressure waveform indicated by the dotted line represents that achieved by the constitution including only the first puffer chamber 2, and that indicated by the solid line represents that achieved by adding the second puffer chamber 10 to the first puffer chamber 2.

As seen from the above, in the portion which only served conventionally for accommodating the flange of the puffer cylinder, the second puffer chamber is newly provided to increase the total volume of the puffer chamber, thereby enabling a continuing arc of more than four cycles. Then, a zero missing current which may occur at the time of a following line fault can be interrupted with a circuit breaker having substantially the same size as the conventional one and with insignificant increase of the weight thereof.

Hereinafter, further embodiments of the present invention are explained with reference to FIGS. 4, 5, 6 and 7. In these drawings, all of the grounding switch gear devices are illustrated in their circuit making conditions.

Figure 4:
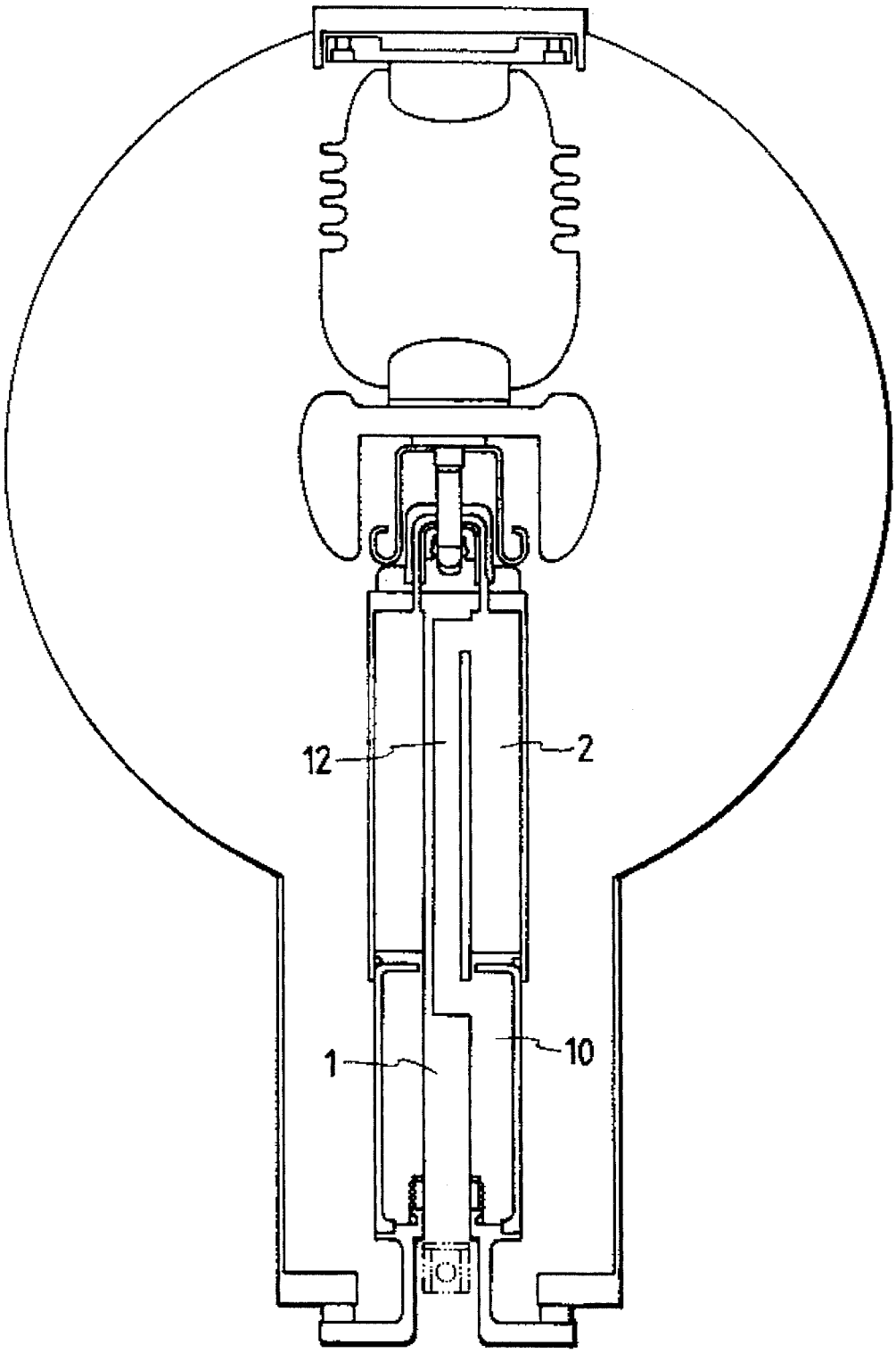
FIG. 4 is a side cross-sectional view of another embodiment of the grounding switch gear device according to the present invention.

In the FIG. 4 embodiment, the first puffer chamber 2 and the second puffer chamber 10 are communicated via a through hole 12 provided in the shaft 1 of the puffer cylinder 11. A specific advantage achieved by the FIG. 4 embodiment is weight reduction of the movable part thereof in comparison with FIG. 1 embodiment.

Figure 5:
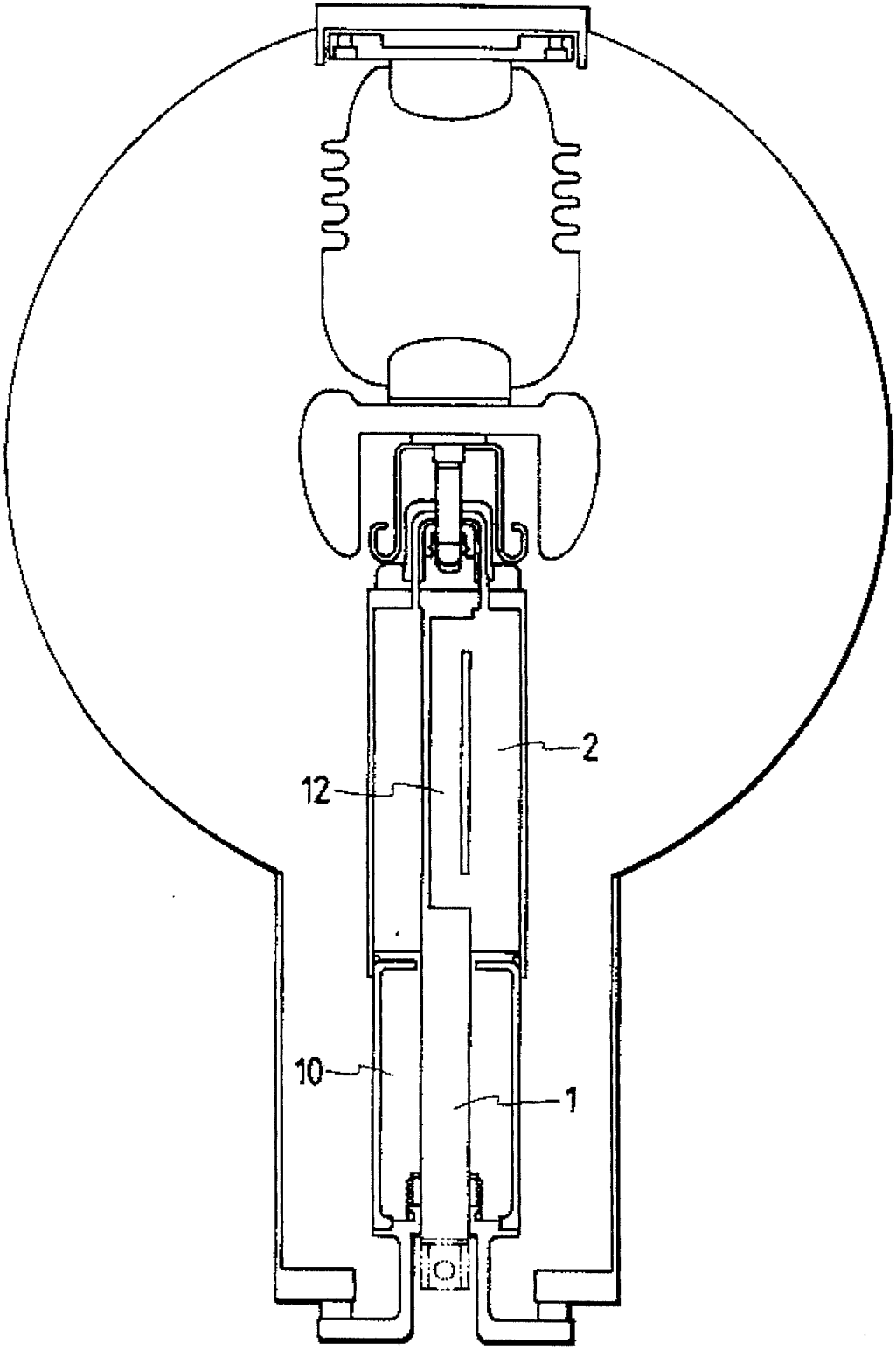
FIG. 5 is a side cross-sectional view of still another embodiment of the grounding switch gear device according to the present invention.

Although the FIG. 5 embodiment is similar to that of FIG. 4, the through hole 12 provided in the shaft 1 of the puffer cylinder 11 is designed not to communicate the first puffer chamber 2 with the second puffer chamber 10 at the time of circuit making condition, but to communicate the first puffer chamber 2 with the second puffer chamber 10 on the way during the circuit breaking operation. A specific advantage achieved by the FIG. 5 embodiment is to further prolong the interruptable arc time span, although the pressure rise of $SF_6$ gas in the second puffer chamber 10 is not so high as those in the FIG. 1 and FIG. 4 embodiments.

Figure 6:
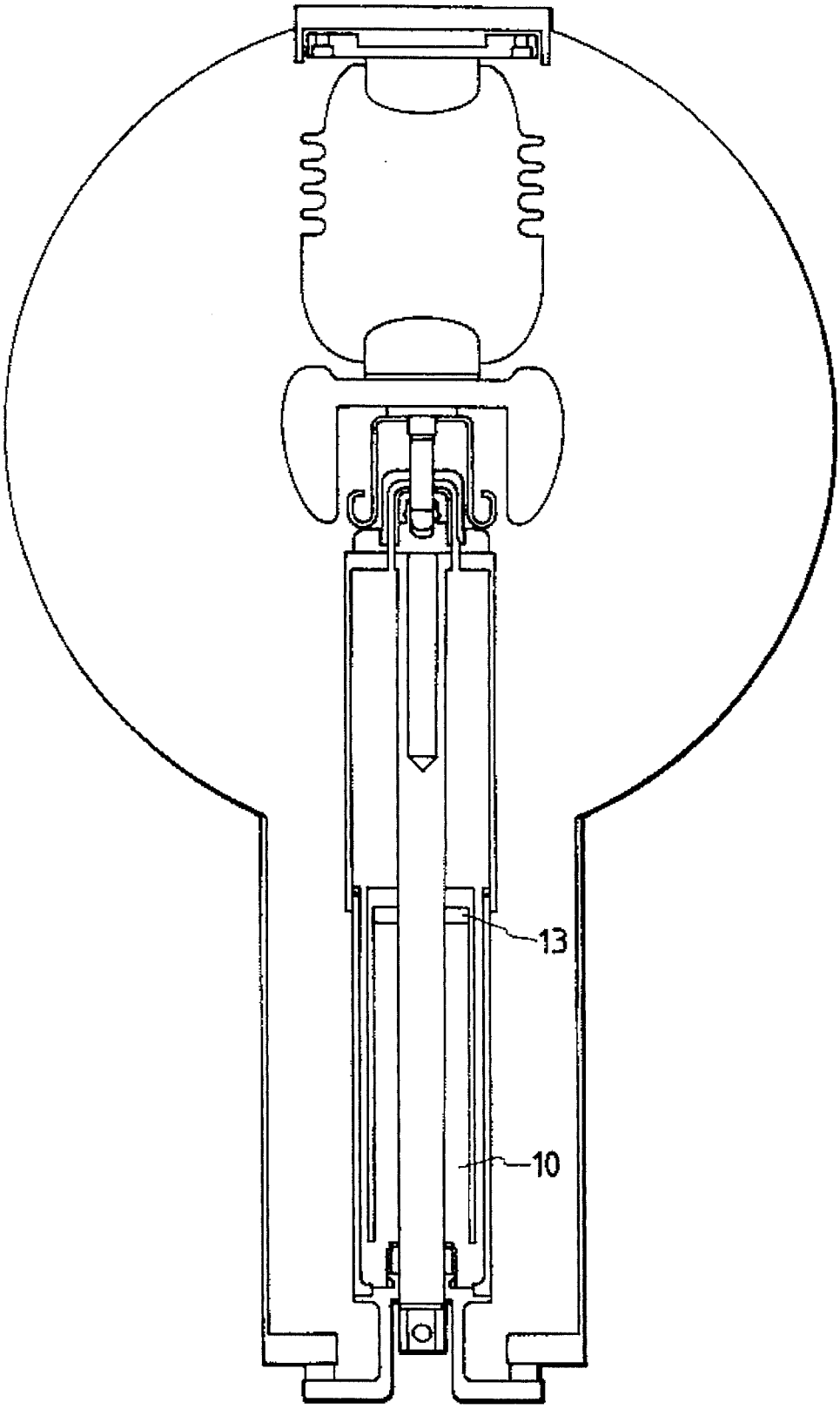
FIG. 6 is a side cross-sectional view of a further embodiment of the grounding switch gear device according to the present invention.

In the FIG. 6 embodiment, a piston 13 is preferably provided in the second puffer chamber 10 in order that $SF_6$ gas in the second puffer chamber 10 is more efficiently blown out than in the FIGS. 1, 4 and 5 embodiments. Since the gas in the second puffer chamber 10 is designed to be also blown out, the total blown out gas amount reaches near two times that in the FIG. 1 embodiment.

Figure 7:
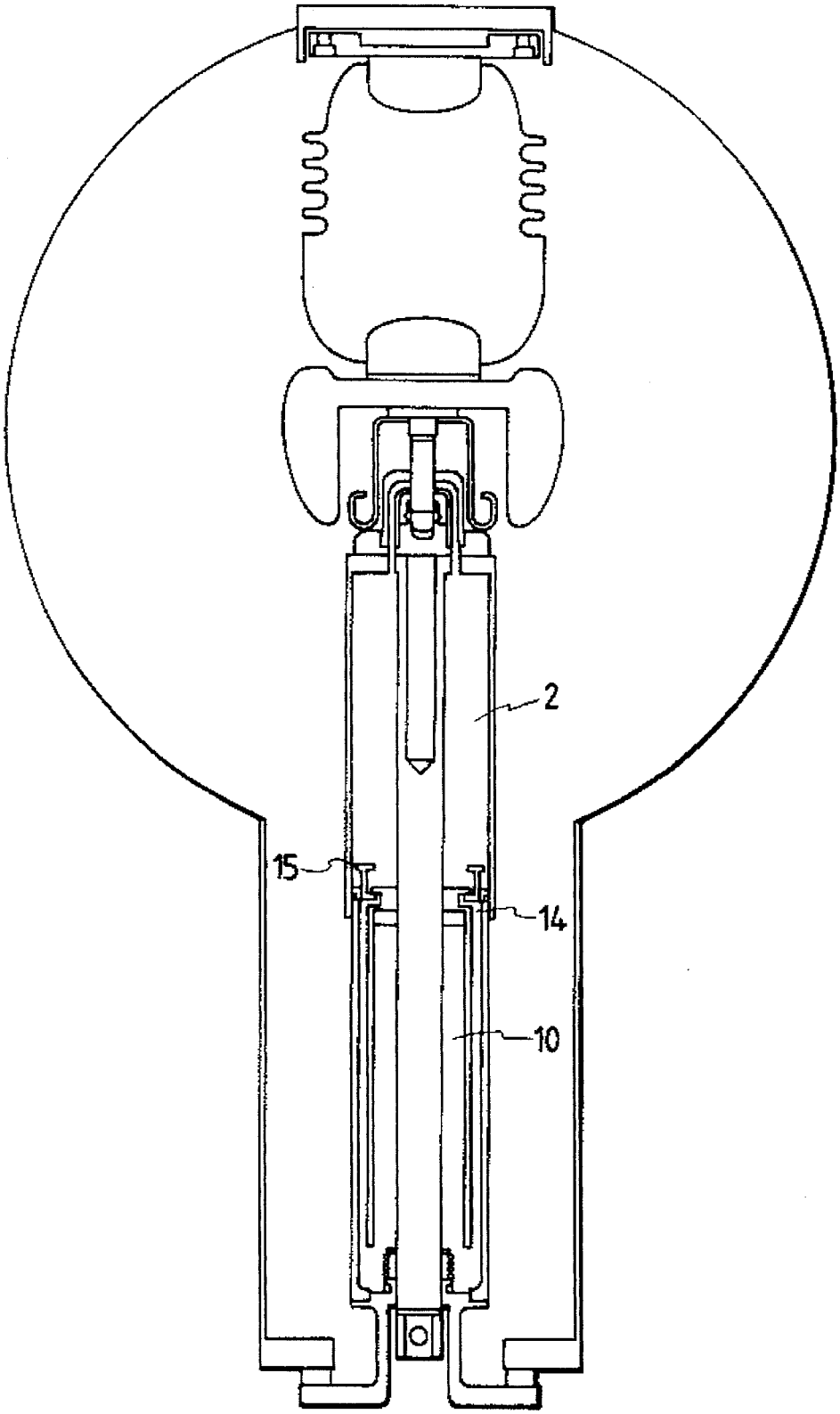
FIG. 7 is a side cross-sectional view of a still further embodiment of the grounding switch gear device according to the present invention.

In the FIG. 7 embodiment, a valve 15 is further provided at a communication hole 14 which is provided between the first puffer chamber 2 and the second puffer chamber 10 of the FIG. 6 embodiment and $SF_6$ gas in the second puffer chamber 10 is also compressed separately from the $SF_6$ gas in the first puffer chamber 2 in order to more efficiently blow out gas, as compared with the FIG. 6 embodiment the timing of the releasing operation of the valve 15 is set at the timing near the end of the separating operation of the circuit breaking unit 4, 5. The structures of the FIG. 6 and 7 embodiments are suitable for current interruption of a large capacity.

Figure 8:
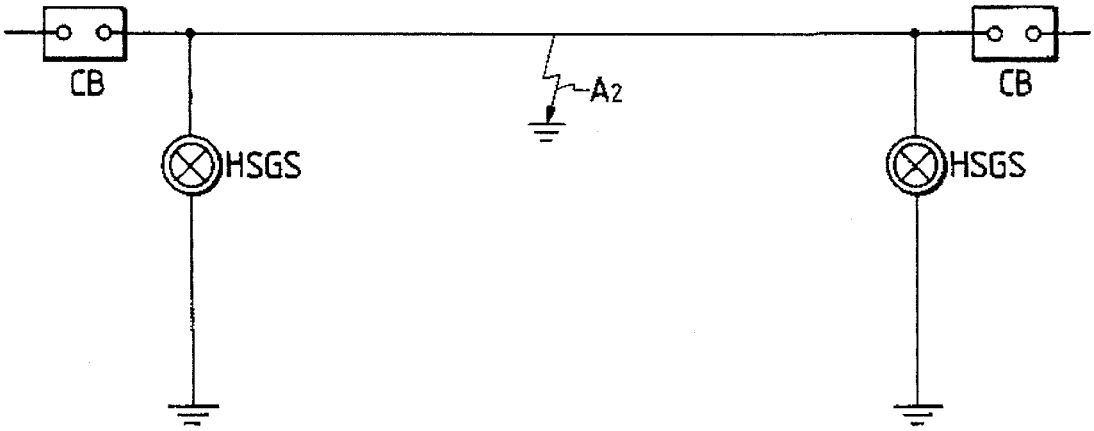
FIG. 8 is a main circuit diagram in which the high speed grounding switch HSGS according to the present invention is disposed.

In an electric power transmission system, when a grounding fault $A_2$ is generated at a power transmission line as illustrated in FIG. 8, the circuit breakers CB provided at both ends of the transmission line immediately disengage the fault line. However, in an ordinary lightning fault, a flashover discharge is generated in an arc horn, and then the discharge extinguishes after the fault current interruption and the fault line restores to the orignal condition such that the power transmission can be restarted.

For this purpose, in an ultra high voltage power transmission system, in order to ensure stability of the system, a so called high speed reclosing which repeats a circuit breaking and circuit making operation within one second is performed.

Now, in a large capacity electric power transmission system, for example a 1,000 KV power transmission system presently under planning, since the electrostatic capacity between transmission lines, and between transmission lines and the ground, increases, and the electrostatic induction due to current flowing through a sound phase increases, therefore, even after the circuit breakers at both ends of the fault line interrupt the fault phase, an arc of about a few seconds, i.e. a so called secondary arc current, possibly continues at the fault point, which makes the high speed reclosing within one second difficult.

In order to extinguish the secondary arc current immediately and to enable the high speed reclosing, a method of grounding both ends of an open circuited fault phase with high speed grounding switch gear devices has been employed.

Figure 9:
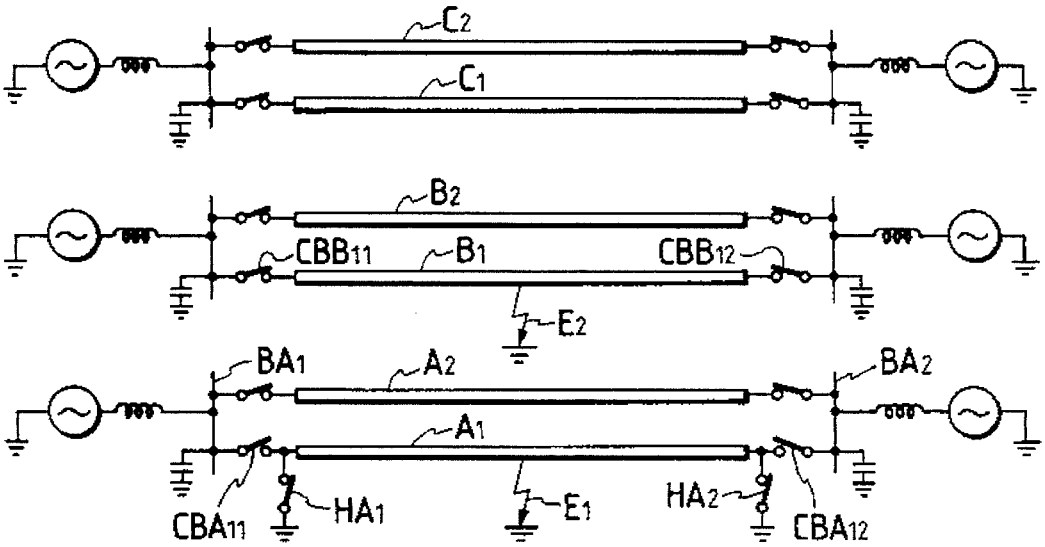
FIG. 9 is a large capacity electric power transmission system diagram to which the high speed grounding switch according to the present invention is applied.

FIG. 9 shows a power transmission lines A1~C2 of a three-phase two-circuit system, wherein both ends of the line A1 are designed to be connected to buses BA1 and BA2 at a substation via circuit breakers CBA11 and CBA12, as well as to be grounded to a grounding line via high speed grounding switch gear devices HA1 and HA2. Now, when there arises a grounding fault E1 at the power transmission line A1 due to lightning, for example, the circuit breakers CBA11 and CBA12 provided at both ends of the line A1 are operated and disengage the line A1 from the bus systems BA1 and BA2. Thereafter, the high speed grounding switch gear devices HA1 and HA2 are closed and the line is connected to the grounding potential to thereby extinguish the secondary arc current continuing at the fault point E1. Then, after opening the high speed grounding switch gear devices HA1 and HA2, a high speed reclosing can be performed by closing the circuit breakers CBA11 and CBA12 provided at the both ends of the power transmission line A1.

Now, during closing of the high speed grounding switch gear devices HA1 and HA2 and after extinguishing the secondary arc current El, when another grounding fault E2 is successively generated at another phase due to multi-lightning, for example, a so called zero missing current condition, in which the waveform of the AC current is suppressed to cross the zero level as illustrated in FIG. 2, appears in the current flowing through the high speed grounding switch gear devices HA1 and HA2, which interruption is sometimes failed with the conventional circuit breaker.

It takes usually a long time of about four cycles to restore the zero missing current condition to an ordinary condition. The time of about four cycles corresponds to the sum of a relaying time of about 2 cycles from the detection of the following fault E2 and generation of a circuit breaking command signal and the circuit breaking time of about 2 cycles of the circuit breakers CBB11 and CBB12. In order to enable the high speed grounding switch gear devices HA1 and HA2 to interrupt the above explained zero missing current, the high speed grounding switch gear devices are required to have a long interruptable time span of about four cycles.

However, in the conventional puffer type gas circuit breaker, all of the compressed gas in the puffer cylinder is blown out to the contact portion at the end of the circuit breaking operation, and it has been impossible to achieve such a long interruptable time span of about four cycles.

In a gas circuit breaker with a puffer cylinder according to the present invention, in which $SF_6$ gas is compressed and the compressed $SF_6$ gas is blown out toward the contact portion to extinguish an arc generated there, because of the provision of the second puffer chamber at the portion for accommodating the flange of the puffer cylinder, the total volume of the puffer chamber is expanded and the $SF_6$ gas in the second puffer chamber provided at the flange accommodating portion remaining as if a dead volume can be blown out to the contact portion even after completion of the circuit breaking operation. Thereby, a zero missing current which may occur at the time of a following line fault can be interrupted with a circuit breaker having substantially the same size as the conventional one and with insignificant increase of the weight thereof.

We claim:

1. A grounding switch gear device including a pair of engageable and disengageable stationary and movable electrodes constituting a circuit breaking unit, a puffer cylinder having a substantially cylindrical flange portion and a shaft portion at the end of which said movable electrode is fixedly secured, and a hollow puffer piston slidably supported along the inner circumferential face of the flange portion of said puffer cylinder, said puffer cylinder and said puffer piston in combination constituting a first puffer chamber, wherein a gas in the first puffer chamber is compressed in association with separation of said movable electrode from said stationary electrode during a separating operation and is blown out between said movable and stationary electrodes, characterized in that said puffer piston has a cylindrical shape sealed with respect to an external space to permit containment into the flange portion of the puffer cylinder at the circuit breaking position of said circuit breaking unit, and the inner space of said cylindrically-shaped puffer piston is constituted as a second puffer chamber in communication with the first puffer chamber.

2. A grounding switch gear device according to claim 1, characterized in that a partition wall of said puffer piston between the first puffer chamber and the second puffer chamber is provided with an opening which permits direct communication between the first puffer chamber and the second puffer chamber.

3. A grounding switch gear device according to claim 1, characterized in that the shaft portion of said puffer cylinder is provided with a through hole which permits direct communication between the first puffer chamber and the second puffer chamber.

4. A grounding switch gear device according to claim 3, characterized in that an opening position of said through hole is selected to permit direct communication between the first puffer chamber and the second puffer chamber on the way during the separating operation.

5. A grounding switch gear device according to claim 1, further comprising a second piston in said second puffer chamber, said second piston being operated in association with said circuit breaking unit, wherein a gas compressed by both first and second puffer chambers in the separating operation is blown into said circuit breaking unit.

6. A grounding switch gear device according to claim 5, further comprising a partition wall of said puffer piston between the first puffer chamber and the second puffer chamber having an opening which permits direct communication between the first puffer chamber and the second puffer chamber, and a valve which performs a releasing operation in association with the separating operation at the opening so as to permit communication between the first puffer chamber and the second puffer chamber on the way during the separating operation.

7. A grounding switch gear device according to claim 6, characterized in that the releasing operation of the valve provided at the opening which permits communication between the first puffer chamber and the second puffer chamber is timed to take place near the end of the separating operation of said circuit breaking unit.

8. A puffer type gas circuit breaker including a pair of engageable and disengageable stationary and movable electrodes constituting a circuit breaking unit, comprising a puffer cylinder carrying said movable electrode and a puffer piston slidably supported inside said puffer cylinder, said puffer cylinder and puffer piston in combination constituting a first puffer chamber containing a gas which is compressed when said movable electrode is disengaged from said stationary electrode and is blown between said movable and stationary electrodes, characterized in that said puffer piston is constituted by an outwardly sealed cylinder to form a second puffer chamber directly communicating with the first puffer chamber.

9. The puffer type gas circuit breaker of claim 8, wherein a partition wall of said puffer piston between the first puffer chamber and the second puffer chamber has an opening which permits said direct communication between the first puffer chamber and the second puffer chamber.

10. The puffer type gas circuit breaker of claim 8, wherein said puffer cylinder has a shaft portion extending through said cylindrical puffer piston and having a through-hole which permits said direct communication between the first and second puffer chambers.

11. The puffer type gas circuit breaker of claim 10, wherein an opening position of the through-hole is selected so as to permit said direct communication between the first and second puffer chambers on the way during the separating operation.

12. The puffer type gas circuit breaker of claim 9, further comprising a second piston in the second puffer chamber which is operated in association with said circuit breaking unit, wherein gas compressed by both said first and second puffer chambers during the separating operation is blown into said circuit breaking unit.

13. The puffer type gas circuit breaker of claim 12, wherein said opening is provided with a valve which performs a releasing operation in association with the separating operation to permit communication between the first and second puffer chambers on the way during the separating operation.

14. The puffer type gas circuit breaker of claim 13, wherein the releasing operation of the valve is timed to take place near the end of the separating operation of said circuit breaking unit.

15. The puffer type gas circuit breaker of claim 9, wherein said outwardly sealed cylinder forming said second puffer chamber occupies a space surrounded by the puffer cylinder when said circuit breaking unit is at the circuit breaking position.

16. A puffer type gas circuit breaker including a pair of engageable and disengageable stationary and movable electrodes constituting a circuit breaking unit, comprising a puffer cylinder carrying said movable electrode and a puffer piston slidably supported inside said puffer cylinder, said puffer cylinder and puffer piston in combination constituting a first puffer chamber containing a gas which is compressed when said movable electrode is disengaged from said stationary electrode and is blown between said movable and stationary electrodes, and further comprising a second puffer chamber formed on the other side of said puffer piston from said first puffer chamber in two-way communication with said first puffer chamber through an opening formed at said puffer piston and serving as a buffer space for said first puffer chamber during the separating operation, whereby the gas blasting time is prolonged at least for more than four cycles of the frequency of a power transmission line to which the puffer type gas circuit breaker is applied.

* * * * *